US006874556B2

(12) United States Patent
Barbosa

(10) Patent No.: US 6,874,556 B2
(45) Date of Patent: Apr. 5, 2005

(54) TRANSFER DEVICE FOR TRANSFERRING A LIGHTWEIGHT OBJECT

(75) Inventor: Valdemar Barbosa, Fresnes (FR)

(73) Assignee: NS Testut SAS, Bethune (FR)

( * ) Notice: Subject to any disclaimer, the term of this patent is extended or adjusted under 35 U.S.C. 154(b) by 101 days.

(21) Appl. No.: 10/347,194

(22) Filed: Jan. 21, 2003

(65) Prior Publication Data

US 2003/0136521 A1 Jul. 24, 2003

(30) Foreign Application Priority Data

Jan. 22, 2002 (FR) ..... 02 00739

(51) Int. Cl.[7] ..... B65C 9/14; B65C 9/28

(52) U.S. Cl. ..... 156/556; 156/569; 156/570; 156/DIG. 31; 156/DIG. 37; 294/64.1

(58) Field of Search ..... 156/556, 566–572, 156/DIG. 31, DIG. 37, DIG. 38, DIG. 42; 414/680, 737, 627; 294/64.1, 64.3

(56) References Cited

U.S. PATENT DOCUMENTS

| | | | | |
|---|---|---|---|---|
| 3,729,362 A | | 4/1973 | French et al. | |
| 4,114,769 A | * | 9/1978 | Cuniberti et al. | 414/816 |
| 4,557,514 A | * | 12/1985 | Cushman et al. | 294/64.1 |
| 5,300,181 A | | 4/1994 | Yamaguchi | |

FOREIGN PATENT DOCUMENTS

| | | |
|---|---|---|
| DE | 199 52 375 A1 | 5/2001 |
| FR | 2715145 | 7/1995 |

* cited by examiner

*Primary Examiner*—Sue A. Purvis
(74) *Attorney, Agent, or Firm*—Young & Thompson

(57) ABSTRACT

A transfer device for transferring a lightweight object by pneumatic pulse, the device including a pneumatic pulse generator connected to a transfer member, wherein the pneumatic pulse generator includes bellows installed between a fixed base and a plate actuated by an actuating member so as to flatten the bellows between the base and the plate, the transfer member including a hollow guide in communication with the bellows, the hollow guide being closed by a piston sliding under the effect of a pneumatic pulse against the force of a return spring.

18 Claims, 2 Drawing Sheets

8
7
4
3
9.1
6
1
9
5
2
9.2
1'
22
20
15
18
16
19
21
E
17
X

TRANSFER DEVICE FOR TRANSFERRING A LIGHTWEIGHT OBJECT

The invention relates to a transfer device for transferring a lightweight object, which device finds its application, in particular, in the field of sticking on labels by means of automatic machines integrated in packaging lines.

BACKGROUND OF THE INVENTION

Document FR 2 715 145 discloses a transfer device including a pneumatic pulse generator associated with a pneumatic circuit provided at its end with a transfer member.

When the pneumatic pulse generator is actuated, a label present under the transfer member is subjected to the effect of a jet of air which propels the label towards an object to be labeled.

The pneumatic pulse generator includes a cylindrical chamber in which a piston controlled by an electromagnet is a sliding fit. Fitting requires precise machining which makes the device expensive.

In addition, such a device must be capable of affixing labels on objects of various heights. When the face of the object which receives the label is at a distance from the transfer member, it has been observed that the label tends to be offset relative to the position it ought to have on the object to be labeled, sliding sideways relative to the pneumatic jet which entrains it.

In order to remedy that drawback at least in part, the prior art shown by that document also comprises a label applicator in which an auxiliary pusher is actuated by the pneumatic pulse, the label then being displaced by said pusher. The resulting device is complicated with numerous moving parts which can break down and which require frequent maintenance.

OBJECTS AND SUMMARY OF THE INVENTION

The invention seeks to propose means for applying the label to an object, that does not present the above-mentioned drawbacks due to a mechanical structure that is complex. In the device of the invention, the pneumatic pulse generator comprises bellows installed between a fixed base and a plate actuated by an actuating member so as to flatten the bellows between the base and the plate, the transfer member comprising a hollow guide in communication with the bellows, the hollow guide being closed by a piston sliding under the effect of a pneumatic pulse against a return spring.

The air expelled from the bellows thus actuates the piston of the transfer member which pushes the label towards the object to be labeled. The label therefore remains continuously in contact with the piston, thereby eliminating the risk of the label being offset, in particular when the object to be labeled has a label-receiving face that is far away from the transfer member. There is positive contact between the face of the piston forming the label pusher and said label, which contact provides sufficient friction to prevent the label from moving sideways under the effect of aerodynamic forces generated by air resistance.

In addition, the use of bellows enables the pneumatic pulse generator to avoid having any part that requires precise machining. Since guidance of the piston over the hollow guide also does not need to be precise, the characteristics of the invention lead to a significant reduction in the cost of the transfer device.

In a first embodiment, the hollow guide of the transfer member is mounted on the base so as to open out directly into the bellows of the pneumatic pulse generator.

In a second embodiment of the invention, the transfer member is separate from the pneumatic pulse generator, a tube being arranged between the transfer member and the pneumatic pulse generator so as to put the hollow guide into communication with the bellows.

This disposition enables the pneumatic pulse generator to be offset in order to be placed in a less cluttered zone of the machine in which the device is integrated.

In an aspect of the invention, the bellows includes an opening associated with means to close said opening when the bellows is flattened.

The opening enables additional air to be admitted in the event of the bellows not being completely re-inflated following prior actuation of the pusher. When next actuated, the opening of the bellows being closed enables air to be directed preferentially towards the hollow guide.

The closure means for closing the opening of the bellows are preferably constituted by the base or by the plate.

The base or the plate is thus pressed against the periphery of the opening so as to close said opening when the bellows is flattened. Naturally, the sealing achieved in this way is not perfect, but given the low pressures involved in the device, it is quite sufficient.

In an advantageous aspect, the piston is slidably mounted on the outside of the hollow guide. The sliding diameter, with reasonable operating clearance enabling the piston to be guided correctly over the hollow guide, is sufficient for leakage to occur naturally between the piston and the hollow guide. This leakage enables the displacement speed of the piston to be controlled, thereby preventing the piston from impacting too violently against the object to be labeled.

In a particular aspect of the invention, the piston is associated with anti-rotation means preventing it from rotating relative to the base.

The bellows is advantageously resilient.

BRIEF DESCRIPTION OF THE DRAWINGS

Other characteristics and advantages of the invention appear more clearly from the following description of a particular non-limiting embodiment of the invention. Reference is made to the accompanying drawings, in which.

MORE DETAILED DESCRIPTION

Figure 1:
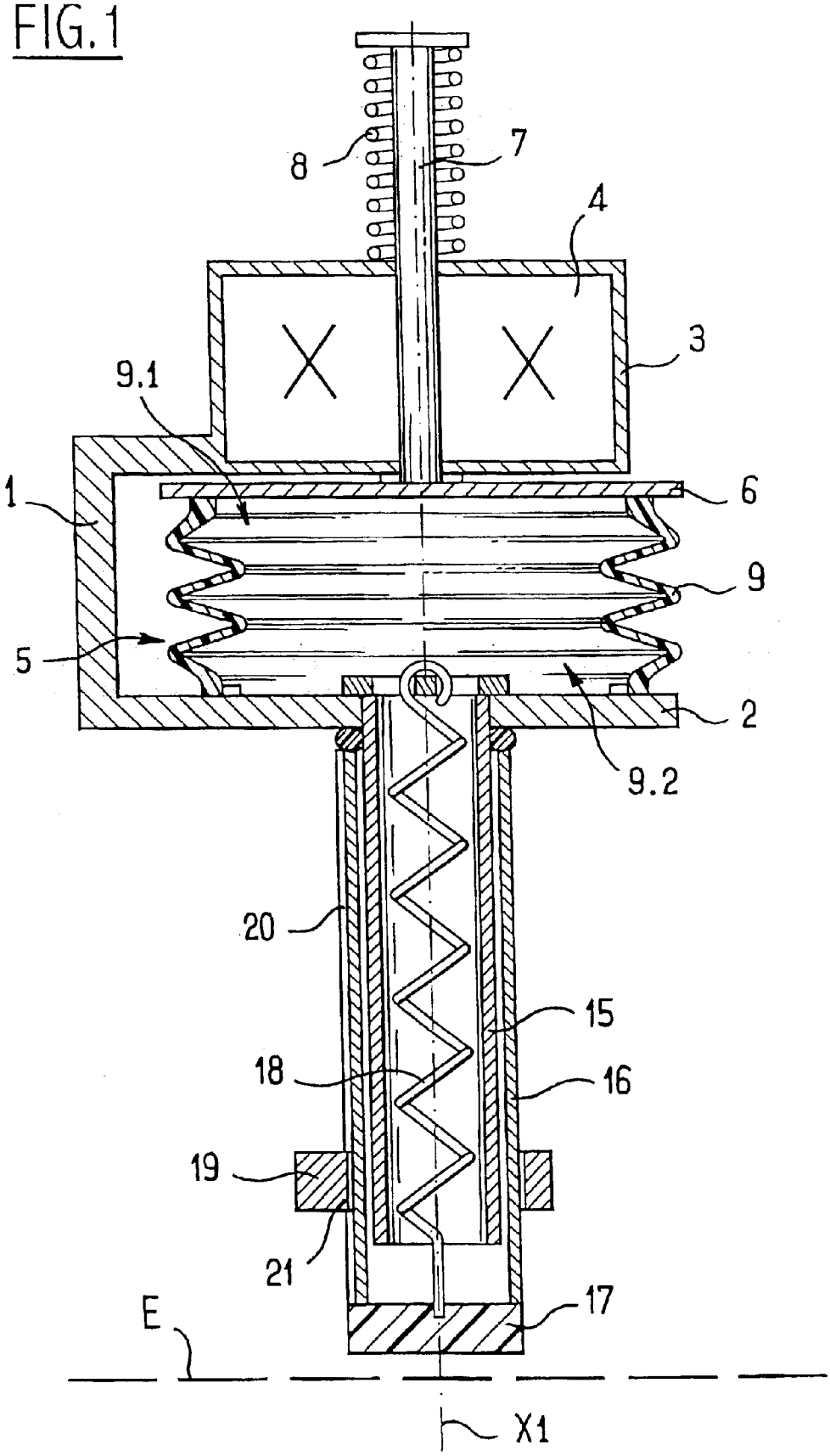
FIG. 1 is a section view of an embodiment of the invention.

With reference to FIG. 1, the transfer device of the invention firstly comprises a pneumatic pulse generator which comprises a frame 1 forming a cavity 5 between a base 2 and a support 3 for an electromagnet 4.

A plate 6 is slidably mounted on the body 1 to slide along an axis X1 perpendicular to the base 2. The plate 6 extends inside the cavity 5 parallel to the base 2. The plate 6 is connected to a rod 7 which slides in the body and which is subjected to the action of the electromagnet 4. When the electromagnet 4 is powered, the plate 6 is propelled towards the base 2. A spring 8 returns the plate 6 towards an initial position (shown in the figure) in which the space between the plate 6 and the base 2 is at a maximum.

A resilient bellows 9 extends between the plate 6 and the base 2. The bellows 9 is axially defined by two openings 9.1 and 9.2 defined by peripheries extending along planes parallel to the base 2 and bearing respectively against the plate 6 and the base 2.

The transfer device of the invention also comprises a transfer member composed of a hollow guide 15 extending along the axis X1 and which is fixed to the base 2 so as to open out inside the bellows 9. A piston 16 is slidably mounted on the outside of the guide 15, the piston 16 being fitted with an end pad 17 which closes the piston 16. A return spring 18 acts on the piston 16 to return said piston towards the base 2.

The device operates as follows: A presentation device (not described) presents a sticky label E under the pad 17. The electromagnet 4 is then powered by a brief pulse of electricity, thereby propelling the plate 6 towards the base 2 and causing the bellows 9 to be flattened.

Since the openings 9.1 and 9.2 are sealed by the plate 6 and by the base 2, the air inside the bellows is expelled towards the hollow guide 15, thereby propelling the piston 16.

An impulse is thus imparted to the piston 16 and the pad 17 pushes the label E until the label comes into contact with the receiving face of an object to be labeled. The piston 16 is then stopped and the spring 18 returns the piston towards the base 2.

Meanwhile, the electromagnet 4 has ceased to act, and the plate 6 returns to its initial position under the effect of the spring 8. The bellows 9 thus returns to its original position under the effect of its own resilience.

Some of the air which was taken into the hollow guide 15 is pushed by the piston 16 into the bellows 9, and if necessary, additional air is supplied via passages between the openings 9.1 and 9.2 of the bellows and the plate 6 and the base 2 respectively.

Other things being equal, the displacement speed of the piston 16 is controlled by the clearance existing between the hollow guide 15 and the piston 16. The clearance distributed over the outside circumference of the hollow guide 15 allows air to leak which enables the speed of the piston to be controlled, and thus limits the impact force of the pad against the object to be labeled. Although the clearance between the piston 16 and the hollow guide 15 must be small enough to ensure that the piston 16 is guided over the hollow guide 15 without jamming, it does not need to be precise. The hollow guide 15 and the piston 16 can thus be made out of commercially-available hollow tubing, thereby further reducing the cost of manufacturing the device.

To reduce the risk of the label E rotating while moving towards the object to be labeled, it is advantageous to provide an anti-rotation device preventing the piston 16 from rotating. To this end, the piston 16 is slidably mounted inside a ring 19 that is fixed relative to the body 1. The ring 19 includes an inwardly-projecting portion 21 which co-operates with a longitudinal groove 20 in the piston 16 so that the piston 16 is prevented from rotating. In a variant (not shown), anti-rotation means could also be provided between the piston 16 and the hollow guide 15, e.g. a pin passing through the piston, said pin having an end that is received in a groove of the hollow guide.

Figure 2:
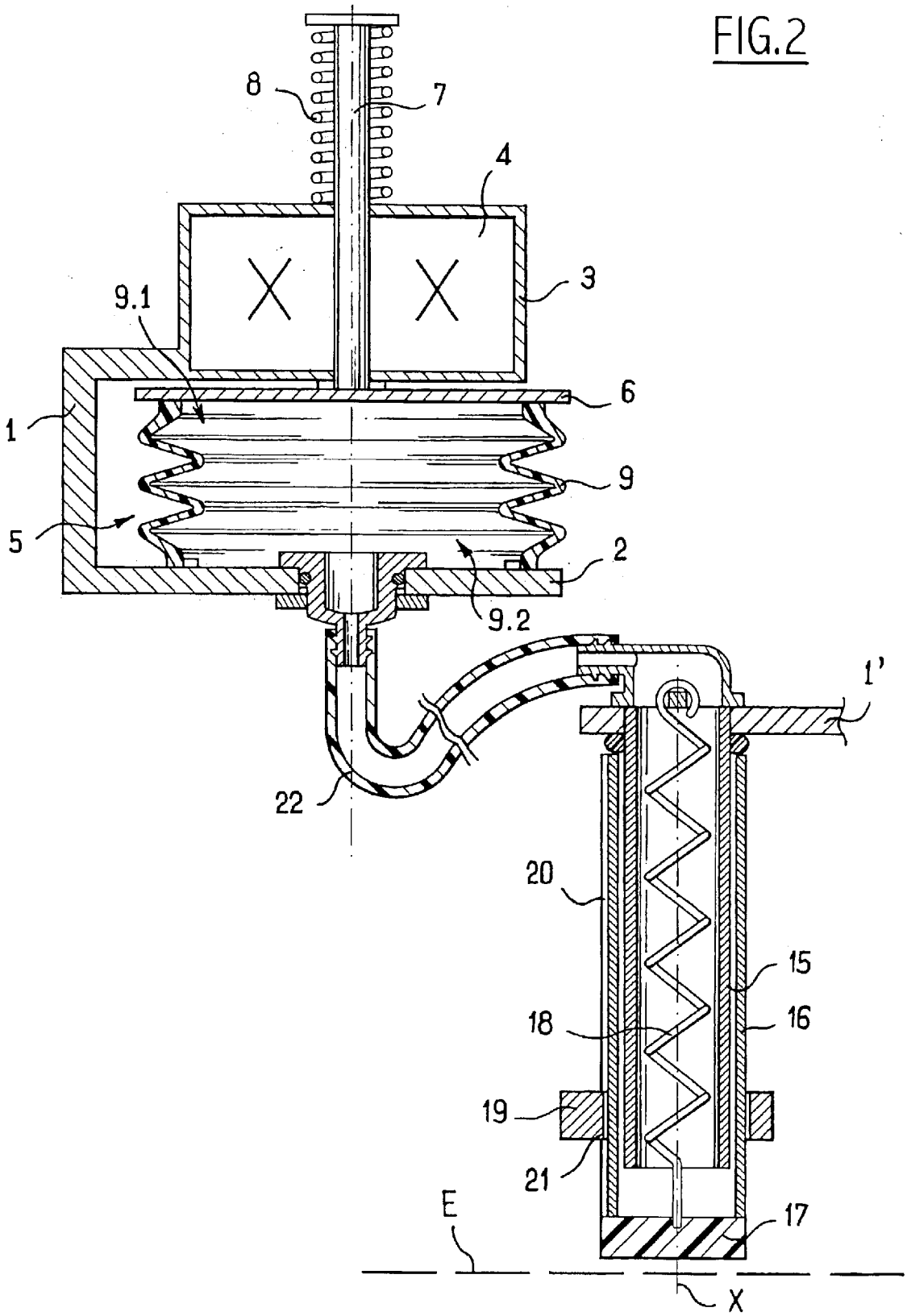
FIG. 2 is a section view of a variant embodiment of the invention.

In a variant embodiment shown in FIG. 2, the pneumatic pulse generator can be separate from the transfer member. The hollow guide 15 of the transfer member is no longer secured to the body 1, but is mounted on a body 1' which is separate from the body 1 and which can be movable relative to said body 1. The hollow guide 15 communicates with the bellows 9 by means of a tube 22, in this case a flexible hose.

This disposition is advantageous in its application to a labeler in which there is a need to modify the label-application zone by means of a motor system. The pneumatic pulse generator is placed on a stationary portion of the labeler, and only the transfer member is disposed on a moving portion of the labeler. The inertia of the moving portion is thus reduced.

In addition, the mechanical separation between the bodies 1 and 1' authorizes various orientations to be taken up between the axis X1 of the bellows 9 and the axis X of the hollow guide 15. For example, the bellows 9 can by horizontal, whereas the piston can be vertical or oblique so as to be presented always substantially perpendicularly to the surface which is to receive the label.

The invention is not limited to the particular embodiment described above, but, on the contrary, covers any variant which is within the ambit of the invention as defined by the claims.

In particular, although the actuating member has been shown as being an electromagnet, any other actuating member capable of pushing the plate could be envisaged without departing from the invention (electric motor, hydraulic jack, . . . ).

The opening of the bellows could be constituted by a check valve which closes while the bellows is being flattened, and which opens while the bellows is expanding.

Although the piston is shown as sliding on the outside of the hollow guide, the invention also applies to a piston sliding on the inside of the hollow guide.

Although it is stated that the bellows is resilient, the invention also covers the use of a non-resilient bellows coupled to the plate and to the base.

What is claimed is:

1. A transfer device for transferring a lightweight object by pneumatic pulse, the device comprising:

a pneumatic pulse generator air-connected to a transfer member, wherein the pneumatic pulse generator comprises bellows generating a pneumatic pulse, and installed between a fixed base and a plate actuated by an actuating member so as to flatten the bellows between the base and the plate to generate the pneumatic pulse expelled from the bellows, the transfer member comprising a hollow guide in air-communication with the bellows, the hollow guide being closed by a piston sliding under the effect of the pneumatic pulse expelled from the bellows against the force of a return spring.

2. A device according to claim 1, wherein the hollow guide of the transfer member is mounted on the base so as to open out directly into the bellows of the pneumatic pulse generator.

3. A device according to claim 1, wherein the transfer member is separate from the pneumatic pulse generator, a tube being arranged between the transfer member and the pneumatic pulse generator so as to put the hollow guide into communication with the bellows.

4. A device according to claim 1, wherein the bellows includes at least one opening which is closed when the plate is actuated.

5. A device according to claim 1, wherein the piston is slidably mounted on the outside of the hollow guide.

6. A device according to claim 1, wherein the piston is provided with anti-rotation means preventing it from rotating relative to the base.

7. A device according to claim 1, wherein the bellows is resilient.

8. A transfer device, comprising:

a frame (1) forming a cavity (5) between a base (2) and an electromagnet support (3);

a plate (6) slidably mounted on the body and slidable along a first axis (X1) perpendicular to the base, the plate extending inside the cavity parallel to the base;

a rod (7) connected to the plate and sliding in the body;

a pulse-powered electromagnet (4) mounted on the support and acting on the rod, the electromagnet, in operation, propelling the plate towards the base;

a spring (8) positioned to return the plate towards an initial position in which a space between the plate and the base is at a maximum;

a resilient bellows (9) extending between the plate and the base;

a transfer member comprising a hollow guide (15) extending along the first axis (X1) and operatively connected to the base, the transfer member being open to the bellows;

a piston (16) slidably mounted on an outside of the guide;

an end pad (17) attached to an end of the piston, the end pad for contacting an item;

a return spring (18) acting on the piston to return said piston towards the base, wherein, a pulse of electricity applied to the electromagnet propels the plate towards the base, causing the bellows to be flattened and air expelled from the bellows into the hollow guide and into the piston to displace the piston and end pad along the first axis (X1).

9. The device of claim 8, further comprising:

an anti-rotation device preventing the piston from rotating.

10. The device of claim 9, wherein, the piston is slidably mounted inside a ring fixed relative to the body, the ring including an inwardly-projecting portion cooperating with a longitudinal groove in the piston so that the piston 16 is prevented from rotating.

11. The device of claim 8, wherein the hollow guide is fixed to the base.

12. The device of claim 8, further comprising:

a tube flexibly connecting the hollow guide to the base, wherein the transfer member is movable relative to said body.

13. A transfer device for transferring an object by pneumatic pulse, the device comprising:

a pneumatic pulse generator; and a transfer member air-connected to the pneumatic pulse generator, the pneumatic pulse generator comprising a pulsed actuating member, and a bellows located between a fixed base and a movable plate actuated by the pulsed actuating member, the pulsed actuating member moving the plate to flatten the bellows between the base and the plate and expel air from the bellows into the transfer member as a pneumatic pulse of air, the transfer member comprising a hollow guide in air-communication with the bellows, and a piston sliding under effect of the pneumatic pulse of air expelled from the bellows.

14. A device according to claim 13, wherein the hollow guide is mounted on the base so as to open out directly into the bellows.

15. A device according to claim 13, wherein the transfer member is separate from the pneumatic pulse generator, a tube being arranged between the transfer member and the pneumatic pulse generator so as to put the hollow guide into air-communication with the bellows.

16. A device according to claim 13, wherein the piston is slidably mounted on the outside of the hollow guide.

17. A device according to claim 13, wherein the piston is provided with anti-rotation means preventing the piston from rotating relative to the base.

18. A device according to claim 13, wherein the bellows is resilient.

* * * * *